US011324989B2

(12) United States Patent
Slater

(10) Patent No.: US 11,324,989 B2
(45) Date of Patent: May 10, 2022

(54) WEIGHT-ADJUSTABLE FREE-WEIGHT EXERCISE DEVICE

(71) Applicant: Joshua Eric Slater, Grand Rapids, MI (US)

(72) Inventor: Joshua Eric Slater, Grand Rapids, MI (US)

( * ) Notice: Subject to any disclaimer, the term of this patent is extended or adjusted under 35 U.S.C. 154(b) by 73 days.

(21) Appl. No.: 17/007,995

(22) Filed: Aug. 31, 2020

(65) Prior Publication Data

US 2021/0060374 A1 Mar. 4, 2021

Related U.S. Application Data

(63) Continuation-in-part of application No. 29/707,235, filed on Sep. 26, 2019, now Pat. No. Des. 898,135.

(60) Provisional application No. 62/893,666, filed on Aug. 29, 2019.

(51) Int. Cl.
*A63B 21/075* (2006.01)
*A63B 21/00* (2006.01)

(52) U.S. Cl.
CPC ..... *A63B 21/075* (2013.01); *A63B 21/4035* (2015.10)

(58) Field of Classification Search
CPC ..... A63B 21/075; A63B 21/4035
See application file for complete search history.

(56) References Cited

U.S. PATENT DOCUMENTS

| | | | | |
|---|---|---|---|---|
| 5,496,240 | A * | 3/1996 | Damm | A63B 21/072 482/93 |
| 9,498,676 | B1 * | 11/2016 | Emick | A63B 21/062 |
| 10,188,899 | B1 * | 1/2019 | Acuna, Jr. | A63B 23/0405 |
| 11,130,014 | B2 * | 9/2021 | Sisler | A63B 21/075 |
| 2014/0057764 | A1 * | 2/2014 | Klukas | A63B 21/072 482/109 |
| 2015/0174445 | A1 * | 6/2015 | Robertson, Jr. | A63B 21/0626 482/93 |
| 2016/0256730 | A1 * | 9/2016 | Bartos | A63B 21/072 |
| 2017/0246495 | A1 * | 8/2017 | Wyncott | A63B 21/0728 |

* cited by examiner

*Primary Examiner* — Joshua Lee

(57) ABSTRACT

A weight-adjustable free-weight exercise device is a portable and ergonomic exercise apparatus. The apparatus allows the weight to be varied according to the strength of the user and the type of exercise being performed by the user. The apparatus includes a tubular housing, a left handle, a right handle, at least one weighted plate, a first locking pin, and a second locking pin. The tubular housing contains the at least one weighted plate. The left handle and the right handle allow a user to grip the apparatus. The at least one weighted plate defines the overall weight of the apparatus. The first locking pin and the second locking pin secures the position of the at least one weighted plate within the tubular housing. The apparatus may further include a first cap and a second cap that fully enclose the at least one weighted plate within the tubular housing.

20 Claims, 6 Drawing Sheets

WEIGHT-ADJUSTABLE FREE-WEIGHT EXERCISE DEVICE

The current application claims a priority to the U.S. provisional patent application Ser. No. 62/893,666 filed on Aug. 29, 2019. The current application is filed on Aug. 31, 2020 while Aug. 29, 2020 was on a weekend.

The current application is a continuation-in-part (CIP) application of the U.S. design application Ser. No. 29/707,235 filed on Sep. 26, 2019.

FIELD OF THE INVENTION

The present invention generally relates to exercise equipment. More specifically, the present invention is a weight-adjustable free-weight exercise device.

BACKGROUND OF THE INVENTION

Gym and fitness equipment typically occupy a lot of space as a range of weights is necessary for a variety of workouts and strength levels. Dumbbells and barbells are standard gym and fitness equipment that require plenty of space. Dumbbells have fixed weights therefore requiring a gym or at-home gym to have multiple dumbbells. Barbells allow for adjustable weights but the barbells and the weights themselves occupy plenty of space. Dumbbells and barbells engage the body in different ways and are used for different exercises, however dumbbells are typically used to target specific muscles. Kettlebells are becoming increasingly popular as the weight of kettlebells is more centralized and encourages proper form and weight distribution throughout the performance of an exercise. Similar with the dumbbells, however, kettlebells have fixed weights and occupy too much space.

It is therefore an objective of the present invention to create a compact, weight-adjustable exercise device that targets specific muscles while encouraging proper distribution of weight. The present invention allows a user to easily reset and adjust the weight of the present invention that best accommodates the strength of the user and the accounts for the exercise being performed with the present invention. The present invention is cost efficient and is convenient for storage, making the present invention ideal for commercial gyms and at-home gyms.

DETAIL DESCRIPTIONS OF THE INVENTION

All illustrations of the drawings are for the purpose of describing selected versions of the present invention and are not intended to limit the scope of the present invention.

Figure 1:
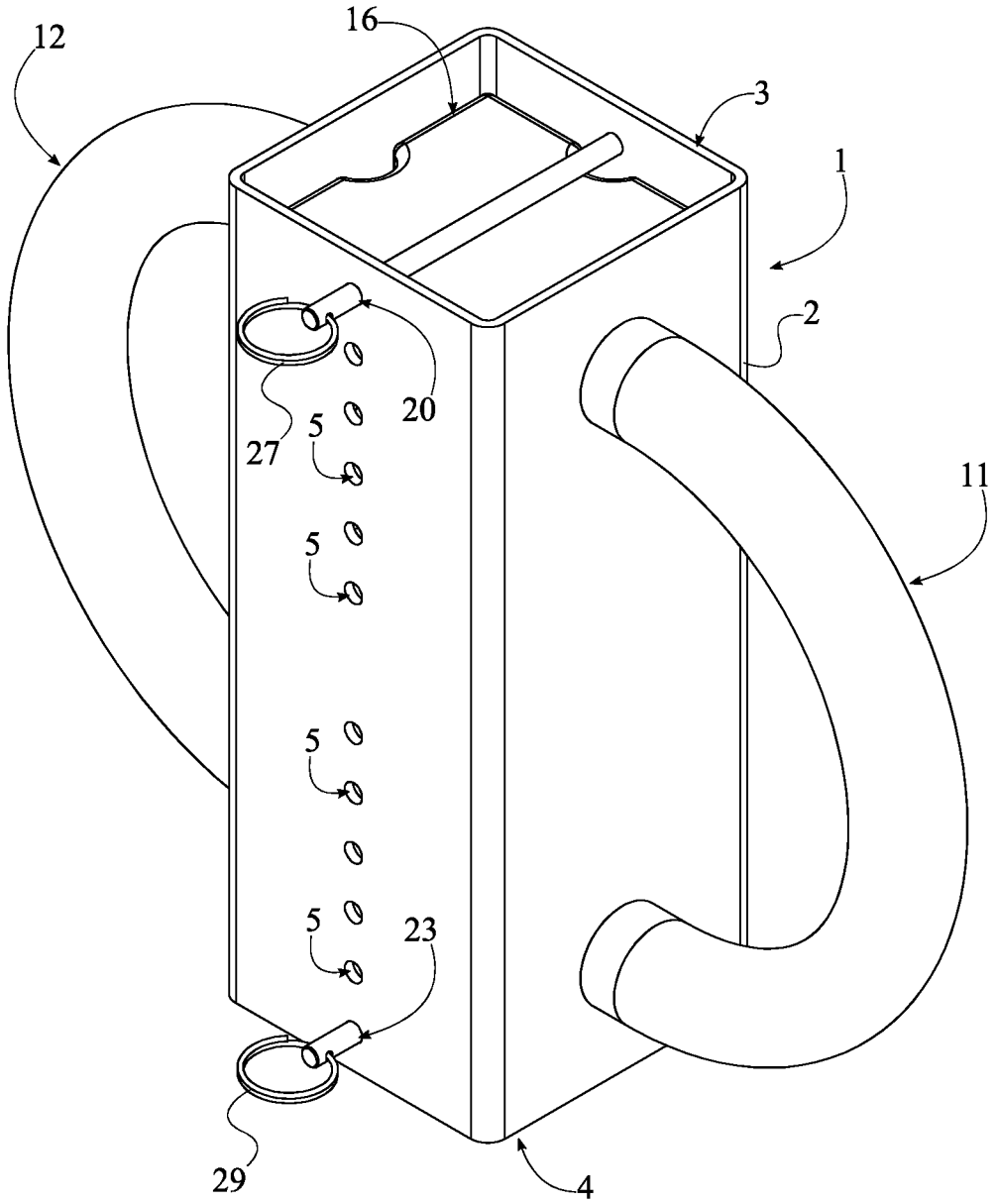
FIG. 1 is a perspective view of the present invention.

The present invention is a weight-adjustable free-weight exercise device that allows a user to vary an overall weight of the present invention for specific exercises. The present invention is compact and ergonomic exercise device that targets specific muscles. The present invention encourages the body of the user to remain balanced throughout the entire exercise and accounts for the strength of the user and the type of exercise being performed by the user. The present invention may be used to perform chest presses, shoulder raises, a variety of leg exercises such as goblet squats, bicep curls, and so on. The present invention accommodates underhand and overhand grips for both the left hand and the right hand. The present invention also accommodates single-handed grips. Furthermore, the present invention is easily stored and requires less space than that of an entire weight rack. In order for the present invention to serve as a universal exercise device while preserving a compact structure, a preferred embodiment of the present invention comprises a tubular housing 1, a left handle 11, a right handle 12, at least one weighted plate 16, a first locking pin 20, and a second locking pin 23, seen in FIG. 1 and FIG. 2. The tubular housing 1 contains the at least one weighted plate 16 and provides a central and balanced distribution of weight for the present invention. The tubular housing 1 preferably has a square cross-section shape. However, it is understood, that various embodiments of the present invention may comprise varying cross-section shapes. The tubular housing 1 comprises a lateral wall 2, a first open end 3, a second open end 4, and a plurality of slots 5. The lateral wall 2 surrounds and orients the at least one weighted plate 16. The first open end 3 and the second open end 4 each allow the at least one weighted plate 16 to enter and exit the tubular housing 1. The left handle 11 and the right handle 12 provide gripping points for the left hand of the user and the right hand of the user, respectively, around the tubular housing 1. The at least one weighted plate 16 defines the overall weight of the present invention that provides resistance against the force of the user while performing an exercise. The first locking pin 20 and the second locking pin 23, together, locks the position of the at least one weighted plate 16 within the tubular housing 1.

The overall configuration of the aforementioned components allows the overall weight of the present invention to be adjustable while preserving the safety and compact structure of the present invention. The at least one weighted plate 16 easily enters and exits the tubular housing 1 as the first open end 3 is positioned opposite the second open end 4 along the lateral wall 2, seen in FIG. 2 and FIG. 3. This arrangement also balances present invention throughout the maneuvering of the tubular housing 1 with left handle 11 and the right handle 12. Furthermore, the left handle 11 is laterally positioned adjacent with the lateral wall 2. Likewise, the right handle 12 is laterally positioned adjacent with the lateral wall 2, opposite the left handle 11. In order for the user to grasp the left handle 11 and the right handle 12, the left handle 11 and the right handle 12 are externally fixed with the tubular housing 1. The first locking pin 20 and the second locking pin 23 are able to engage with the at least one weighted plate 16 positioned within the tubular housing 1, the plurality of slots 5 is serially distributed along the tubular housing 1 and traverses through the lateral wall 2. More specifically, the plurality of slots 5 is positioned in between the left handle 11 and the right handle 12, facilitating the engagement of the first locking pin 20 and the second locking pin 23 around the left handle 11 and the right handle 12. The at least one weighted plate 16 is positioned perpendicular with the lateral wall 2 so that the present invention remains balanced while in use by a user performing an exercise. The at least one weighted plate 16 is slidably engaged within the tubular housing 1 so that the overall weight of the present invention may be easily adjusted with the at least one weighted plate 16. The first locking pin 20 and the second locking pin 23 are slidably engaged through the plurality of slots 5, thereby sandwiching the at least one weighted plate 16 and securing the desired position of the at least one weighted plate 16. Moreover, the at least one weighted plate 16 does not slide as the user performs an exercise with the present invention as the at least one weighted plate 16 is positioned in between the first locking pin 20 and the second locking pin 23.

Figure 2:
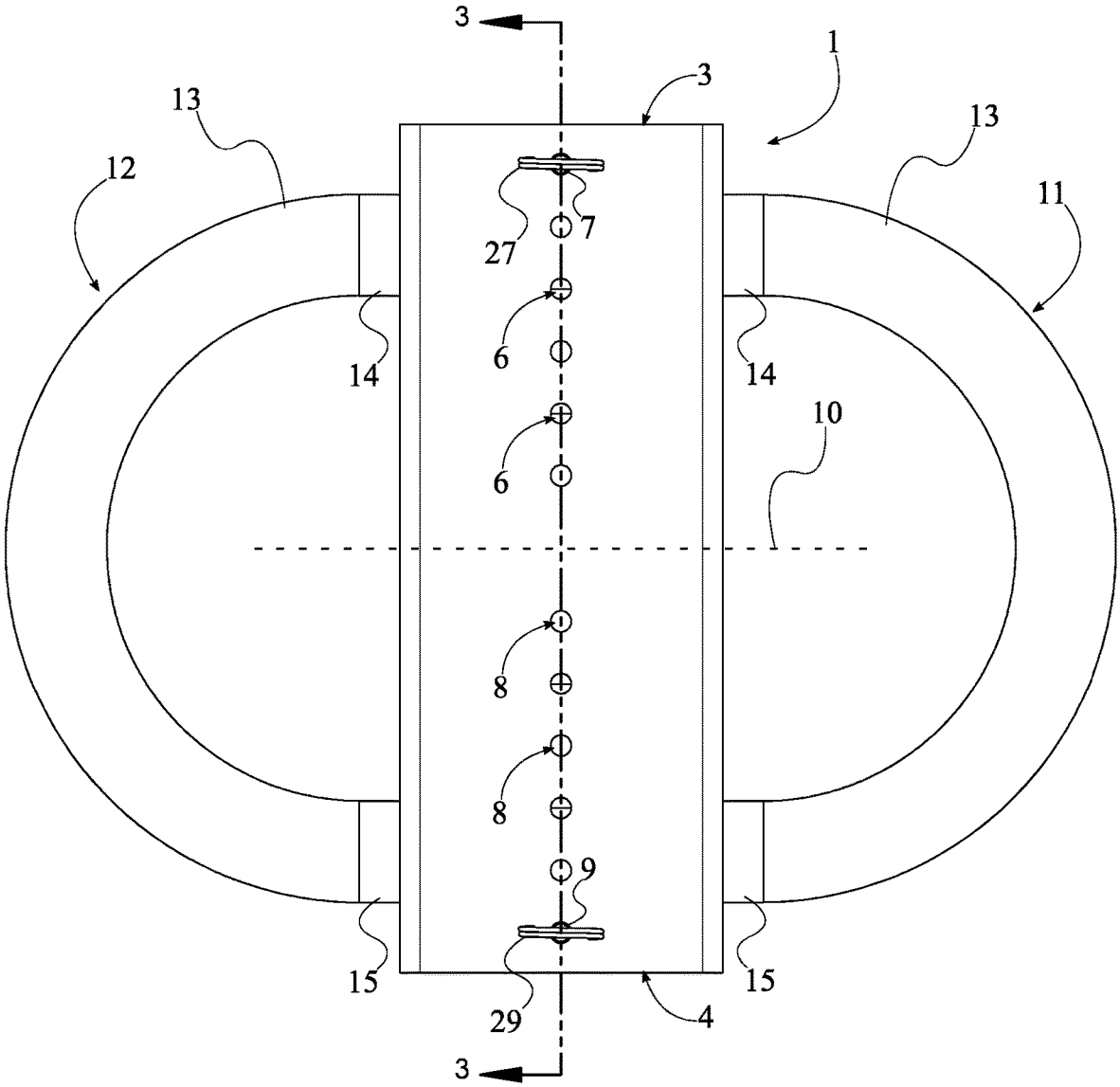
FIG. 2 is a front side view of the present invention.

In order for the overall weight of the present invention to vary with the at least one weighted plate 16, the plurality of slots 5 may comprise a set of first slots 6 and a set of second slots 8, seen in FIG. 2. The set of first slots 6 allows the first locking pin 20 to traverse through the lateral wall 2 of the tubular housing 1 while maintaining the structural integrity of the tubular housing 1. Likewise, the set of second slots 8 allows the second locking pin 23 to traverse through the lateral wall 2 of the tubular housing 1 also while maintaining the structural integrity of the tubular housing 1. The set of first slots 6 is positioned adjacent with the first open end 3, and the set of second slots 8 is positioned adjacent with the second open end 4 so that the at least one weighted plate 16 may be positioned in between the first locking pin 20 and the second locking pin 23. More specifically, the set of first slots 6 is positioned offset from the set of second slots 8, thereby sandwiching the at least one weighted plate 16. The first locking pin 20 is slidably engaged through a first selected slot 7 of the set of first slots 6, and the second locking pin 23 is slidably engaged through a second selected slot 9 of the set of second slots 8. The balance of the present invention is further preserved as the set of first slots 6 and the set of second slots 8 are positioned collinear with each other. This arrangement evenly distributes the weight of the at least one weighted plate 16 within the tubular housing 1 throughout an exercise. More specifically, each of the first slots and a corresponding second slot from the set of second slots 8 are positioned equidistant from a transverse plane 10 of the tubular housing 1, also seen in FIG. 2.

A user may comfortably grip the left handle 11 and the right handle 12 as the left handle 11 and the right handle 12 may each comprise a U-shaped bar body 13, seen in FIG. 2. The U-shaped bar body 13 may comprise a first handle end 14 and a second handle end 15, each of which securely connects the U-shaped bar body 13 with the lateral wall 2. The first handle end 14 is positioned opposite the second handle end 15 along the U-shaped bar body 13 so that the fingers of the user may wrap around the U-shaped bar body 13. More specifically, the first handle end 14 is positioned adjacent with the first open end 3 of the tubular housing 1, and the second handle end 15 is positioned adjacent with the second open end 4 of the tubular housing 1. The U-shaped bar body 13 is stabilized with the tubular housing 1 as the first handle end 14 and the second handle end 15 are fixed onto the lateral wall 2.

Figure 5:
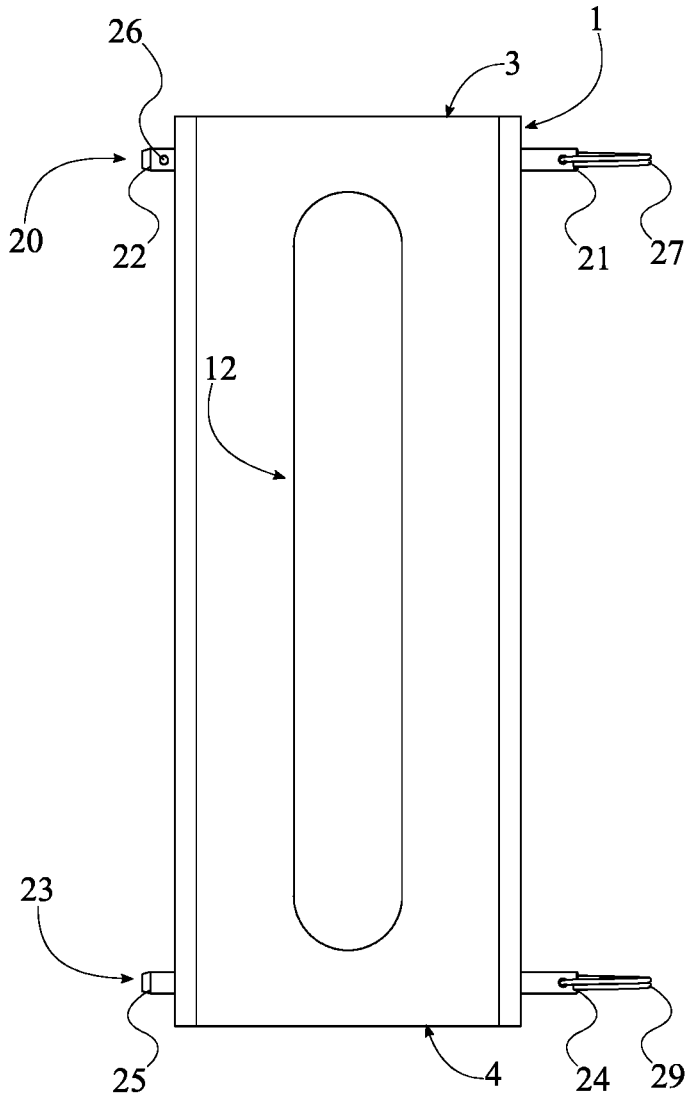
FIG. 5 is a right side view of the present invention.

The first locking pin 20 remains positioned within a first selected slot 7 of the set of first slots 6 as the present invention may further comprise a first fastener 26, seen in FIG. 5. The first fastener 26 is preferably a spring-loaded detent. The first fastener 26 locks and unlocks the first locking pin 20 with the first selected slots. Furthermore, the first locking pin 20 may comprise a first grasping end 21 and a first insertion end 22. The first grasping end 21 prevents the first locking pin 20 from slipping through the first selected slot 7. The first insertion end 22 positions the first fastener 26 along the first locking pin 20 and allows the first locking pin 20 to traverse through the first selected slot 7 with the first fastener 26. The first grasping end 21 is positioned opposite the first insertion end 22 along the first locking pin 20 so that the first locking pin 20 may remain pressed against the at least one weighted plate 16. The first fastener 26 is integrated into the first insertion end 22, locking the position of the first locking pin 20 within the first selected slot 7. More specifically, the tubular housing 1 is positioned in between the first grasping end 21 and the first insertion end 22. In order for the user to maneuver the first locking pin 20, the present invention may further comprise a first keyring 27. The first fastener 26 remains uninhibited by the first key ring as the first keyring 27 is rotatably mounted to the first grasping end 21.

Figure 4:
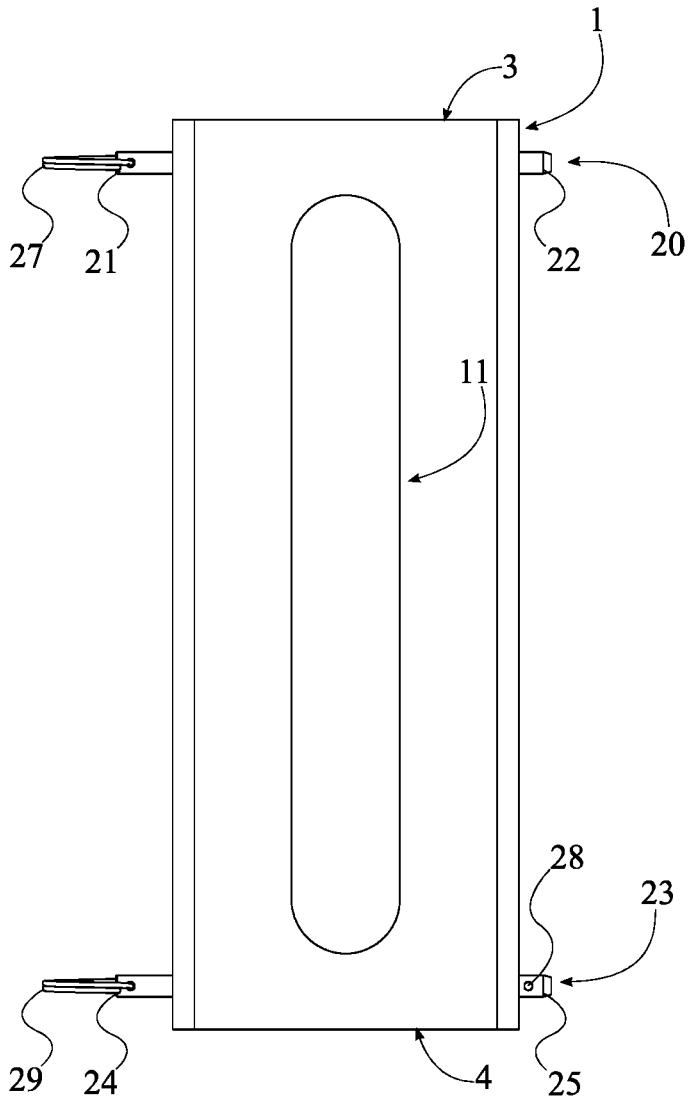
FIG. 4 is a left side view of the present invention.

Likewise, the second locking pin 23 remains positioned within a second selected slot 9 of the set of second slots 8 as the present invention may further comprise a second fastener 28, seen in FIG. 4. The second fastener 28 is preferably a spring-loaded detent. The second fastener 28 locks and unlocks the second locking pin 23 with the second selected slot 9. Furthermore, the second locking pin 23 may comprise a second grasping end 24 and a second insertion end 25. The second grasping end 24 prevents the second locking pin 23 from slipping through the second selected slot 9. The second insertion end 25 positions the second fastener 28 along the second locking pin 23 and allows the second locking pin 23 to traverse through the second selected slot 9 with the second fastener 28. The second grasping end 24 is positioned opposite the second insertion end 25 along the second locking pin 23 so that the second locking pin 23 may remain pressed against the at least one weighted plate 16. The second fastener 28 is integrated into the second insertion end 25, locking the position of the second locking pin 23 within the second selected slot 9. More specifically, the tubular housing 1 is positioned in between the second grasping end 24 and the second insertion end 25. In order for the user to maneuver the second locking pin 23, the present invention may further comprise a second keyring 29. The second fastener 28 remains uninhibited by the second key ring as the second keyring 29 is rotatably mounted to the second grasping end 24.

Figure 6:
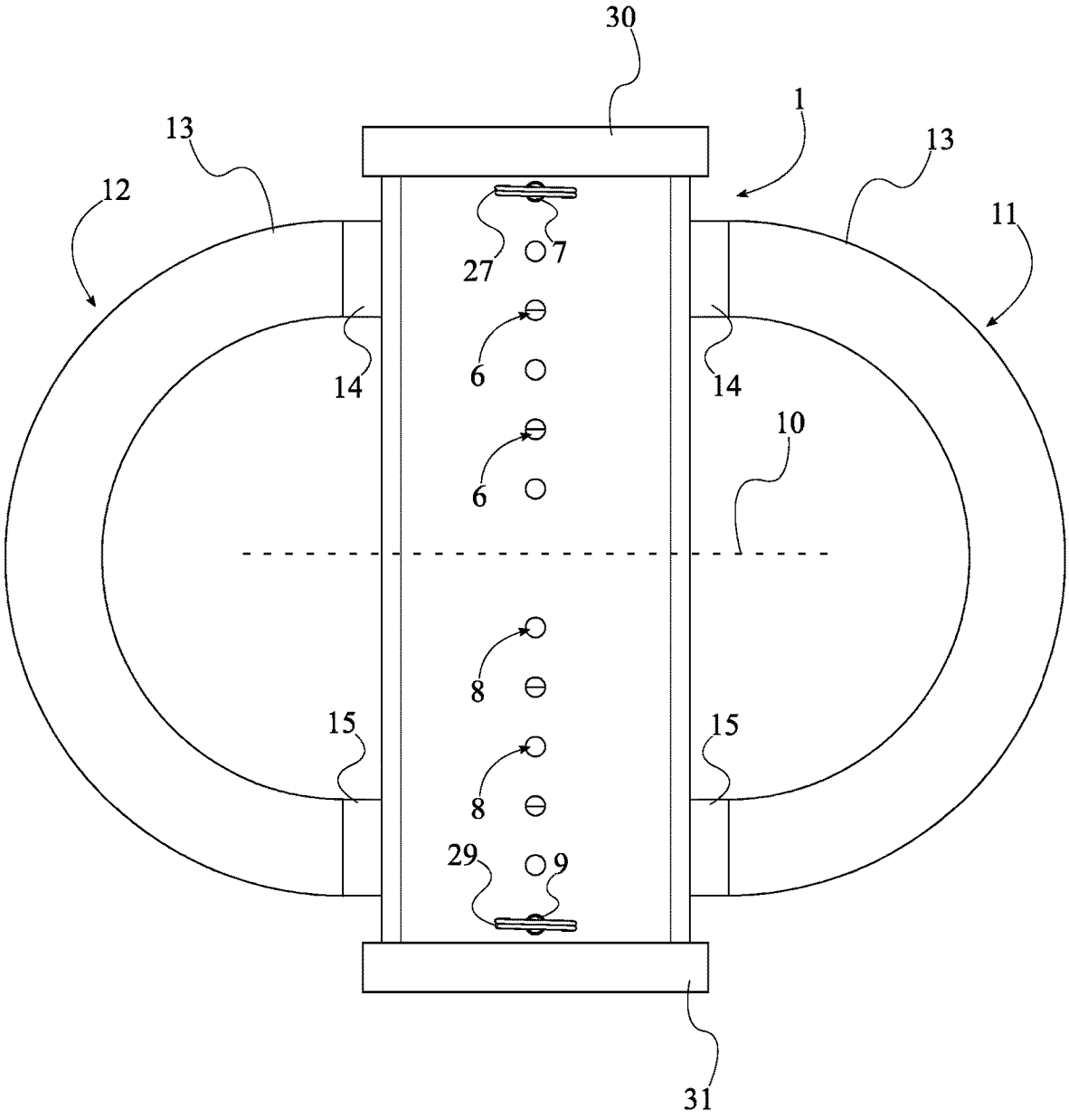
FIG. 6 is a front side view of an alternate embodiment of the present invention.

An alternate embodiment of the present invention may comprise a first cap 30 and a second cap 31, seen in FIG. 6. The first cap 30 and the second cap 31 enclose the tubular housing 1 and cover the at least one weighted plate 16 within the tubular housing 1. The at least one weighted plate 16 is covered along the first open end 3 as the first cap 30 is mounted across the first open end 3. Likewise, the at least one weighted plate 16 is covered along the second open end 4 as the second cap 31 is mounted across the second open end 4.

In order to easily maneuver and access the at least one weighted plate 16 within the tubular housing 1, the at least one weighted plate 16 may comprise a plate body 17 and a plurality of finger-receiving notches 18. The plate body 17 defines the weight of the at least one weighted plate 16. The plurality of finger-receiving notches 18 positions the fingers of a user safely around the plate body 17 while removing the at least one weighted plate 16 from the tubular housing 1 and placing the at least one weighted plate 16 into the tubular housing 1. Each of the plurality of finger-receiving notches 18 are perimetrically integrated into the plate body 17, facilitating the maneuvering of the at least one weighted plate 16. More specifically, the plurality of finger-receiving notches 18 is distributed around the plate body 17, preserving the balanced weight of the at least one weighted plate 16, and consequently the overall present invention.

Figure 3:
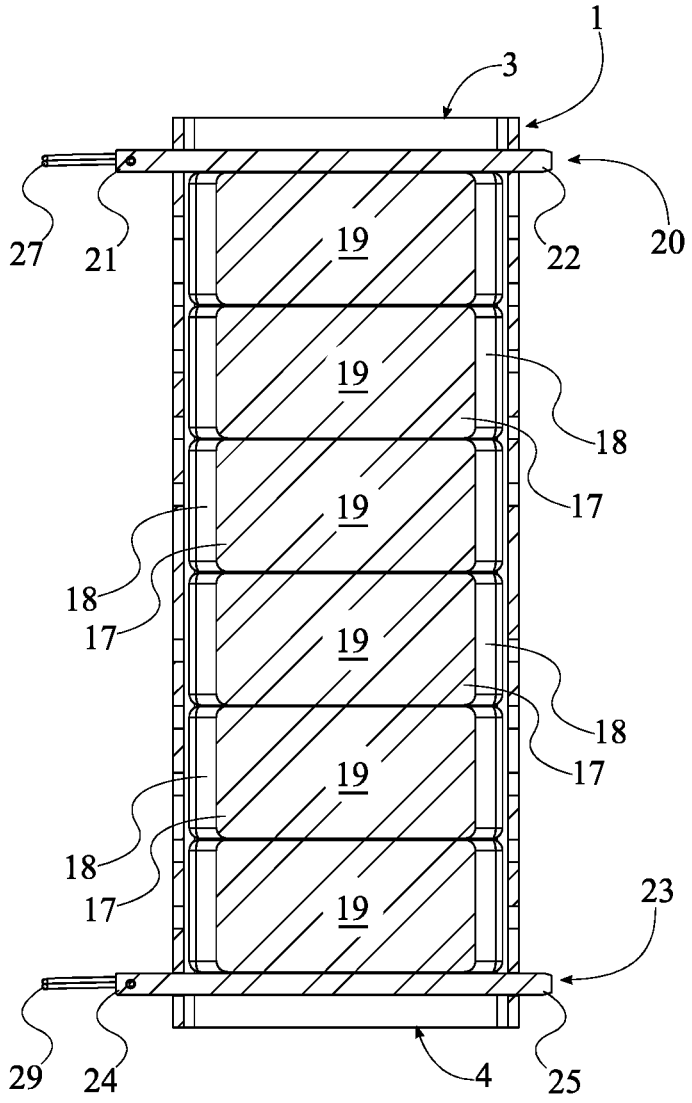
FIG. 3 is a cross-section view taken along line 3-3 in FIG. 2.

The overall weight of the present invention may vary greatly according to the strength of a user and the current type of exercise being performed with the present invention as the at least one weighted plate 16 may comprise a plurality of weighted plates 19, seen in FIG. 3. The plurality of weighted plates 19 is serially positioned upon each other. This arrangement further preserves the balanced structure of the present invention accommodating a variety of exercises performed with the present invention.

Although the invention has been explained in relation to its preferred embodiment, it is to be understood that many other possible modifications and variations can be made without departing from the spirit and scope of the invention as hereinafter claimed.

What is claimed is:

1. A weight-adjustable free-weight exercise device comprises:

a tubular housing;

a left handle;

a right handle;

at least one weighted plate;

a first locking pin;

a second locking pin;

the tubular housing comprises a lateral wall, a first open end, a second open end, and a plurality of slots;

the first open end being positioned opposite the second open end along the lateral wall;

the left handle being laterally positioned adjacent with the lateral wall;

the right handle being laterally positioned adjacent with the lateral wall, opposite the left handle;

the left handle and the right handle being externally fixed with the tubular housing;

the plurality of slots being serially distributed along the tubular housing;

the plurality of slots traversing through the lateral wall;

the plurality of slots being positioned in between the left handle and the right handle;

the at least one weighted plate being positioned perpendicular with the lateral wall;

the at least one weighted plate being slidably engaged within the tubular housing;

the first locking pin and the second locking pin being slidably engaged through the plurality of slots; and, the at least one weighted plate being positioned in between the first locking pin and the second locking pin.

2. The weight-adjustable free-weight exercise device as claimed in claim 1 comprises:

the plurality of slots comprises a set of first slots and a set of second slots;

the set of first slots being positioned adjacent with the first open end;

the set of second slots being positioned adjacent with the second open end;

the set of first slots being positioned offset from the set of second slots;

the first locking pin being slidably engaged through a first selected slot of the set of first slots; and, the second locking pin being slidably engaged through a second selected slot of the set of second slots.

3. The weight-adjustable free-weight exercise device as claimed in claim 2 comprises:

the set of first slots and the set of second slots being positioned collinear with each other; and, each of the first slots and a corresponding second slot from the set of second slots being positioned equidistant from a transverse plane of the tubular housing.

4. The weight-adjustable free-weight exercise device as claimed in claim 1 comprises:

the left handle and the right handle each comprise a U-shaped bar body;

the U-shaped bar body comprises a first handle end and a second handle end;

the first handle end being positioned opposite the second handle end along the U-shaped bar body;

the first handle end being positioned adjacent with the first open end of the tubular housing;

the second handle end being positioned adjacent with the second open end of the tubular housing; and, the first handle end and the second handle end being fixed onto the lateral wall.

5. The weight-adjustable free-weight exercise device as claimed in claim 1 comprises:

a first fastener;

the first locking pin comprises a first grasping end and a first insertion end;

the first grasping end being positioned opposite the first insertion end along the first locking pin;

the first fastener being integrated into the first insertion end; and, the tubular housing being positioned in between the first grasping end and the first insertion end.

6. The weight-adjustable free-weight exercise device as claimed in claim 5, wherein the first fastener is a spring-loaded detent.

7. The weight-adjustable free-weight exercise device as claimed in claim 5 comprises:

a first keyring; and, the first keyring being rotatably mounted to the first grasping end.

8. The weight-adjustable free-weight exercise device as claimed in claim 1 comprises:

a second fastener;

the second locking pin comprises a second grasping end and a second insertion end;

the second grasping end being positioned opposite the second insertion end along the second locking pin;

the second fastener being integrated into the second insertion end; and, the tubular housing being positioned in between the second grasping end and the second insertion end.

9. The weight-adjustable free-weight exercise device as claimed in claim 8, wherein the second fastener is a spring-loaded detent.

10. The weight-adjustable free-weight exercise device as claimed in claim 8 comprises:

a second keyring; and, the second keyring being rotatably mounted to the second grasping end.

11. The weight-adjustable free-weight exercise device as claimed in claim 1 comprises:

a first cap;

a second cap;

the first cap being mounted across the first open end; and, the second cap being mounted across the second open end.

12. The weight-adjustable free-weight exercise device as claimed in claim 1 comprises:

the at least one weighted plate comprises a plate body and a plurality of finger-receiving notches;

each of the plurality of finger-receiving notches being perimetrically integrated into the plate body; and, the plurality of finger-receiving notches being distributed around the plate body.

13. The weight-adjustable free-weight exercise device as claimed in claim 1 comprises:

the at least one weighted plate comprises a plurality of weighted plates; and, the plurality of weighted plates being serially positioned upon each other.

14. A weight-adjustable free-weight exercise device comprises:

a tubular housing;

a left handle;

a right handle;

at least one weighted plate;

a first locking pin;

a second locking pin;

a first cap;

a second cap;

the tubular housing comprises a lateral wall, a first open end, a second open end, and a plurality of slots;

the first open end being positioned opposite the second open end along the lateral wall;

the left handle being laterally positioned adjacent with the lateral wall;

the right handle being laterally positioned adjacent with the lateral wall, opposite the left handle;

the left handle and the right handle being externally fixed with the tubular housing;

the plurality of slots being serially distributed along the tubular housing;

the plurality of slots traversing through the lateral wall;

the plurality of slots being positioned in between the left handle and the right handle;

the at least one weighted plate being positioned perpendicular with the lateral wall;

the at least one weighted plate being slidably engaged within the tubular housing;

the first locking pin and the second locking pin being slidably engaged through the plurality of slots;

the at least one weighted plate being positioned in between the first locking pin and the second locking pin;

the first cap being mounted across the first open end; and, the second cap being mounted across the second open end.

15. The weight-adjustable free-weight exercise device as claimed in claim 14 comprises:

the plurality of slots comprises a set of first slots and a set of second slots;

the set of first slots being positioned adjacent with the first open end;

the set of second slots being positioned adjacent with the second open end;

the set of first slots being positioned offset from the set of second slots;

the first locking pin being slidably engaged through a first selected slot of the set of first slots;

the second locking pin being slidably engaged through a second selected slot of the set of second slots;

the set of first slots and the set of second slots being positioned collinear with each other; and, each of the first slots and a corresponding second slot from the set of second slots being positioned equidistant from a transverse plane of the tubular housing.

16. The weight-adjustable free-weight exercise device as claimed in claim 14 comprises:

the left handle and the right handle each comprise a U-shaped bar body;

the U-shaped bar body comprises a first handle end and a second handle end;

the first handle end being positioned opposite the second handle end along the U-shaped bar body;

the first handle end being positioned adjacent with the first open end of the tubular housing;

the second handle end being positioned adjacent with the second open end of the tubular housing; and, the first handle end and the second handle end being fixed onto the lateral wall.

17. The weight-adjustable free-weight exercise device as claimed in claim 14 comprises:

a first fastener;

a first keyring;

wherein the first fastener is a spring-loaded detent;

the first locking pin comprises a first grasping end and a first insertion end;

the first grasping end being positioned opposite the first insertion end along the first locking pin;

the first fastener being integrated into the first insertion end;

the tubular housing being positioned in between the first grasping end and the first insertion end; and, the first keyring being rotatably mounted to the first grasping end.

18. The weight-adjustable free-weight exercise device as claimed in claim 14 comprises:

a second fastener;

a second keyring;

wherein the second fastener is a spring-loaded detent;

the second locking pin comprises a second grasping end and a second insertion end;

the second grasping end being positioned opposite the second insertion end along the second locking pin;

the second fastener being integrated into the second insertion end;

the tubular housing being positioned in between the second grasping end and the second insertion end; and, the second keyring being rotatably mounted to the second grasping end.

19. The weight-adjustable free-weight exercise device as claimed in claim 14 comprises:

the at least one weighted plate comprises a plate body and a plurality of finger-receiving notches;

each of the plurality of finger-receiving notches being perimetrically integrated into the plate body; and, the plurality of finger-receiving notches being distributed around the plate body.

20. The weight-adjustable free-weight exercise device as claimed in claim 14 comprises:

the at least one weighted plate comprises a plurality of weighted plates; and, the plurality of weighted plates being serially positioned upon each other.

* * * * *